United States Patent [19]

Maehara et al.

[11] Patent Number: 4,644,758

[45] Date of Patent: Feb. 24, 1987

[54] REFRIGERATED DISPLAY CABINET

[75] Inventors: Kazuo Maehara; Toshiyuki Fukuda, both of Isesaki, Japan

[73] Assignee: Sanden Corporation, Gumma, Japan

[21] Appl. No.: 792,606

[22] Filed: Oct. 29, 1985

[30] Foreign Application Priority Data

| | | | |
|---|---|---|---|
| Nov. 26, 1984 | [JP] | Japan | 59-250320 |
| Dec. 28, 1984 | [JP] | Japan | 59-199555[U] |
| May 29, 1985 | [JP] | Japan | 60-79378[U] |

[51] Int. Cl.[4] ..... F25D 21/00; F25B 47/00

[52] U.S. Cl. ..... 62/234; 62/256; 62/278

[58] Field of Search ..... 62/255, 256, 81, 278, 62/199, 152, 234

[56] References Cited

U.S. PATENT DOCUMENTS

| | | | |
|---|---|---|---|
| 3,122,892 | 3/1964 | Beckwith | 62/278 X |
| 3,147,602 | 9/1964 | Beckwith | 62/278 |
| 3,499,295 | 3/1970 | Brennan | 62/278 X |
| 3,638,444 | 2/1972 | Lindahl | 62/278 X |
| 4,122,686 | 10/1978 | Lindahl et al. | 62/278 X |
| 4,122,688 | 10/1978 | Mochizuki et al. | 62/278 X |
| 4,197,716 | 4/1980 | Nussbaum | 62/278 X |

FOREIGN PATENT DOCUMENTS

| | | |
|---|---|---|
| 992490 | 3/1962 | United Kingdom . |
| 1038536 | 5/1964 | United Kingdom . |
| 1259852 | 5/1969 | United Kingdom . |
| 1588790 | 5/1978 | United Kingdom . |

*Primary Examiner*—William E. Wayner

*Attorney, Agent, or Firm*—Banner, Birch, McKie & Beckett

[57] ABSTRACT

A refrigerated display cabinet with multiple air curtains has refrigerating apparatus for refrigerating circulating air. The refrigerating apparatus comprises a compressor, a condenser and two evaporators. The suction sides of both evaporators are connected with one another by a first passage line which includes first and second decompression devices with check valves in series, this line being communicated with the compressor through valve devices. The discharge sides of both evaporators are also connected with one another by a second passage line which includes a pair of check valves, this second line being connected to the compressor through valve devices, respectively. The first and second passage lines are connected with one another and connected to the condenser through a valve device whereby the flow path of the refrigerant can be selectively controlled by operation of the valve devices.

8 Claims, 17 Drawing Figures

REFRIGERATED DISPLAY CABINET

BACKGROUND OF THE INVENTION

This invention relates to a refrigerated display cabinet having improved refrigerating means.

Refrigerated display cabinets which have a front opening and multiple air curtains to isolate the refrigerated space from ambient atmosphere are well known. With this type cabinet, the refrigerated foods or other merchandise can thus be easily removed from or placed in the refrigerated space.

Such cabinets have gained wide acceptance in the food industry. Air to provide an innermost curtain and at least one adjacent outer air curtain is normally circulated through conduits provided within the display cabinet. The innermost air curtain is normally the coldest and the second curtain somewhat warmer. A refrigerating means, normally having one or more evaporators, is located in the innermost curtain conduit for cooling the air.

In this type of refrigerated display cabinet, the innermost curtain conduit and refrigerating means must be defrosted to remove accumulated frost collecting on the evaporators from the circulating air which tends to impede the operation of the equipment. Commercially, such defrosting operations have been achieved with electrical heaters adjacent to the evaporator of the refrigerating means. However, with electrical heater defrosting, the refrigerating operation has to be temporarily heated while still allowing air to continue circulating. Thus, the circulating air is warmed by the high voltage electrical heater. This warm air can then melt frost built up on the evaporator. It is important to melt this frost as rapidly as possible in order to minimize temperature rise of the refrigerated goods and to minimize collection of frost on the refrigerated goods derived from the higher humidity in the recirculated warm air.

One solution to resolve the above mentioned disadvantages is the use of two evaporators through which the refrigerant is passed, respectively, i.e., the refrigerant flows into one of the two evaporators to function in refrigerating the circulating air while the remaining evaporator is stopped to promote the defrosting operation. The flow path of refrigerant to the evaporators is controlled by the frost build up situation on the evaporators. Thus, the refrigeration of the circulating air is continued to maintain the temperature in the refrigerated space of the display cabinet.

However, if two evaporators are disposed parallel to each other within the display cabinet while still maintaining the outer size configuration of the display cabinet then the display space for merchandise within the cabinet is reduced. Conversely, if the display cabinet outer dimensions are maintained along with the desired original size display space and still two evaporators are provided, then the size of the evaporators, i.e., heat transfer area of the evaporators, must be reduced. As a result of reduction of the heat transfer area, the refrigerating means operates with reduced evaporating temperature within the evaporators. Therefore, the refrigerating capacity requirements are increased and the amount of frost build up on the evaporator is increased. Also refrigerant tends to collect in the evaporator during lower load operation of the refrigeranting means.

SUMMARY OF THE INVENTION

It is a primary object of this invention to provide an improved refrigerated display cabinet which has a refrigerating means for effectively continuously cooling air circulating within the cabinet to maintain the cold temperature of the display space.

It is another object of this invention to provide a refrigerated display cabinet which has an effective refrigerating means utilizing relatively small size evaporators.

It is still another object of this invention to provide a refrigerating display cabinet which has an effective defrosting cycle without the need to increase the exterior cabinet size or decrease the display space therewithin.

A refrigerating display cabinet in accordance with this invention comprises an exterior housing, an internal housing within the external housing for storing merchandise, a front opening for access to the interior of the internal housing, a passage formed between the external and internal housings including innner and outer conduits interconnecting respective inlets and outlets extending across opposed edges of the front opening, a circulator for driving through the passage from the outlets to the inlets in the form of inner and outer air curtains, and refrigerating means in the inner conduit for refrigerating the inner curtain of air. The refrigerating means includes a compressor, a condenser and two evaporators. The suction sides of both evaporators are connected with one another by a first passage line in which first and second decompression devices with check valve elements are disposed in series and the ends of the first line respectively communicate with the compressor through first and second valve devices. The discharge sides of both evaporators are also connected with one another by a second passage line in which third and fourth wave devices are disposed in series and respectively connected to the compressor. The first and second passage lines are connected with one another and connected to the condenser through a fifth valve device.

With this construction, the flow path for the refrigerant can be controlled by operation of the valve devices to accomplish two functions for the refrigerating means, namely, hot air defrostng and refrigerating of the air.

Further objects, features and other aspects of this invention will be understood from the detailed description of the preferred embodiments of this invention given with reference to the annexed drawings.

Figure 3:
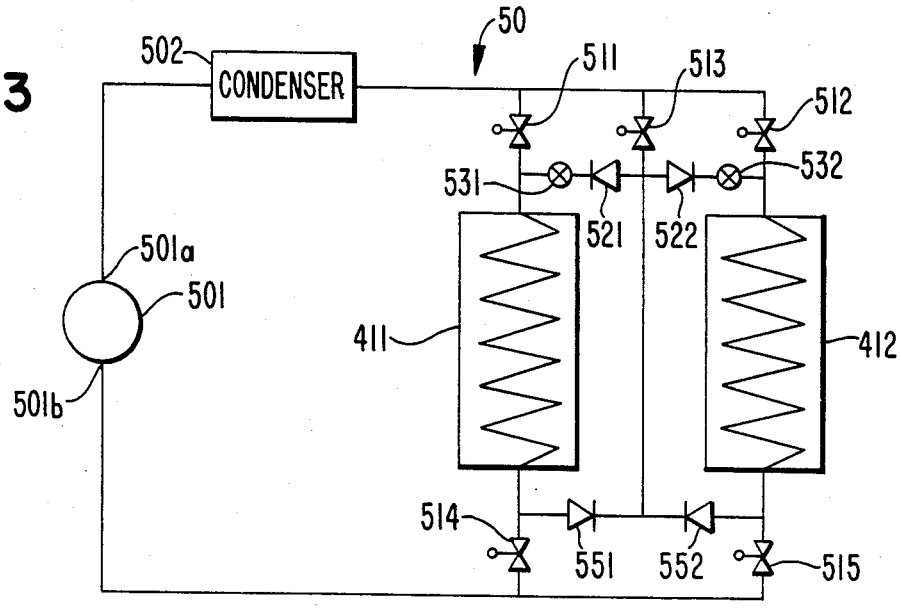
FIG. 3 shows a refrigerating circuit of a refrigerating means according to one embodiment of this invention.

FIGS. *7a*, *7b* and *7c* are charts illustrating an operating situation for each of the evaporators in FIG. 3.

Figure 8:
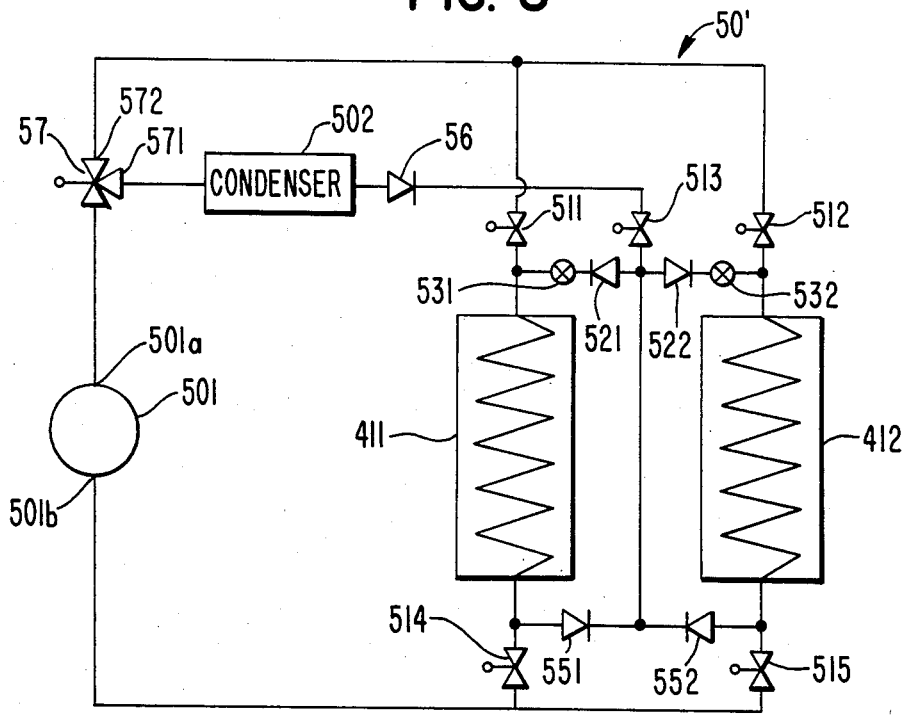

FIG. 8 shows a refrigerating circuit for another embodiment of this invention.

Figure 9:
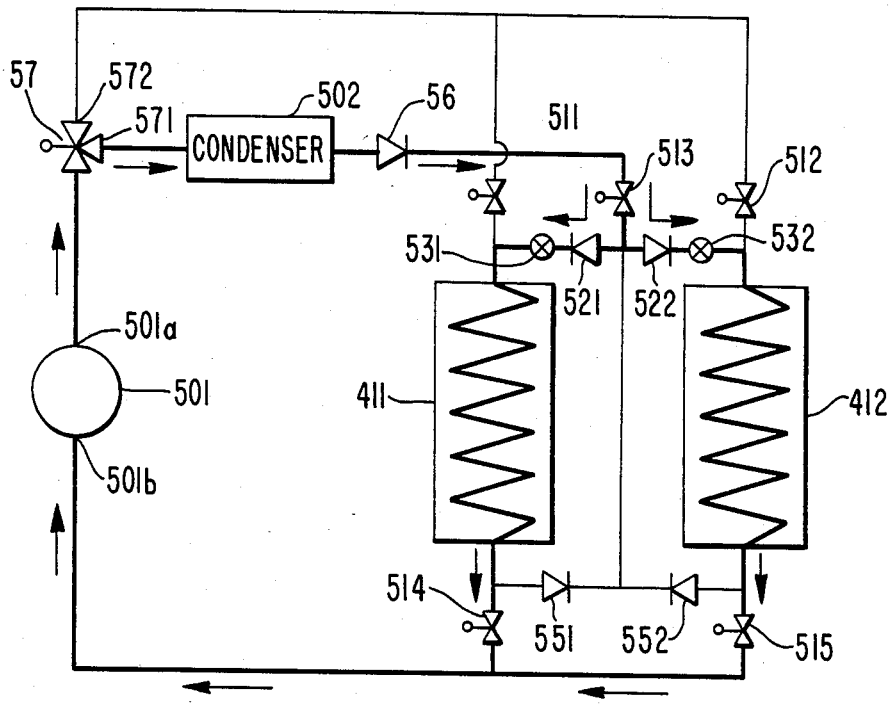
Figure 10:
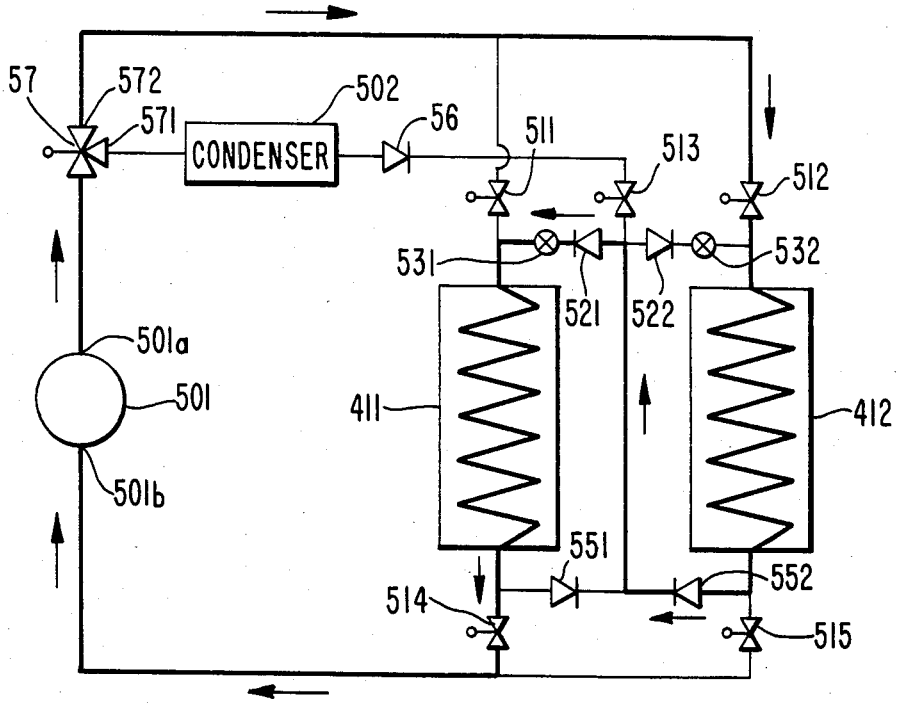
Figure 11:
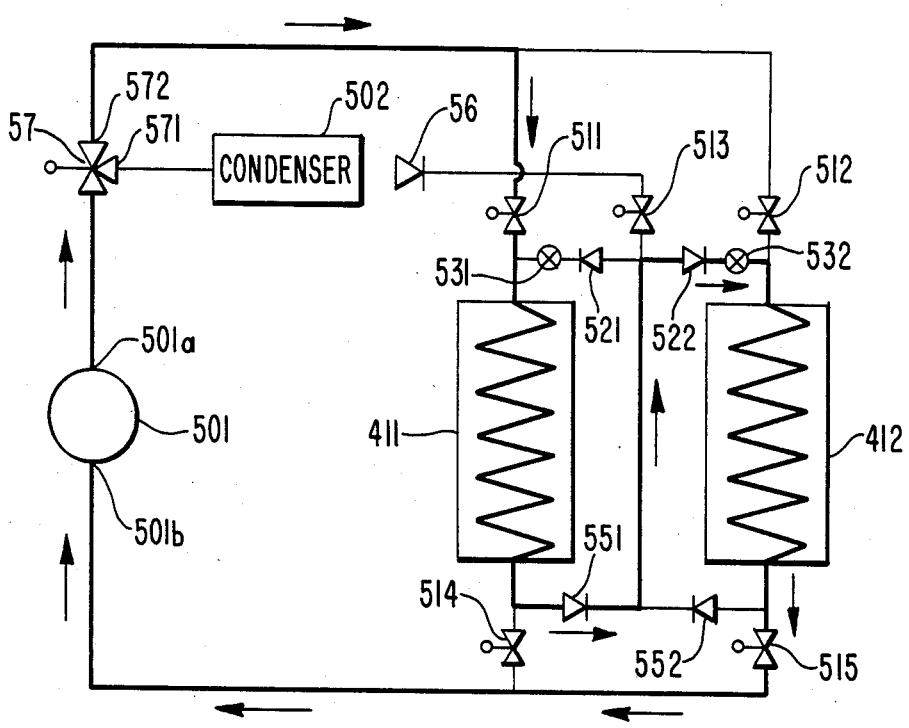

FIGS. 9-11 are schematic views of refrigerating circuits for the FIG. 8 circuit embodiment illustrating operational modes of the refrigerating means.

Figure 12:
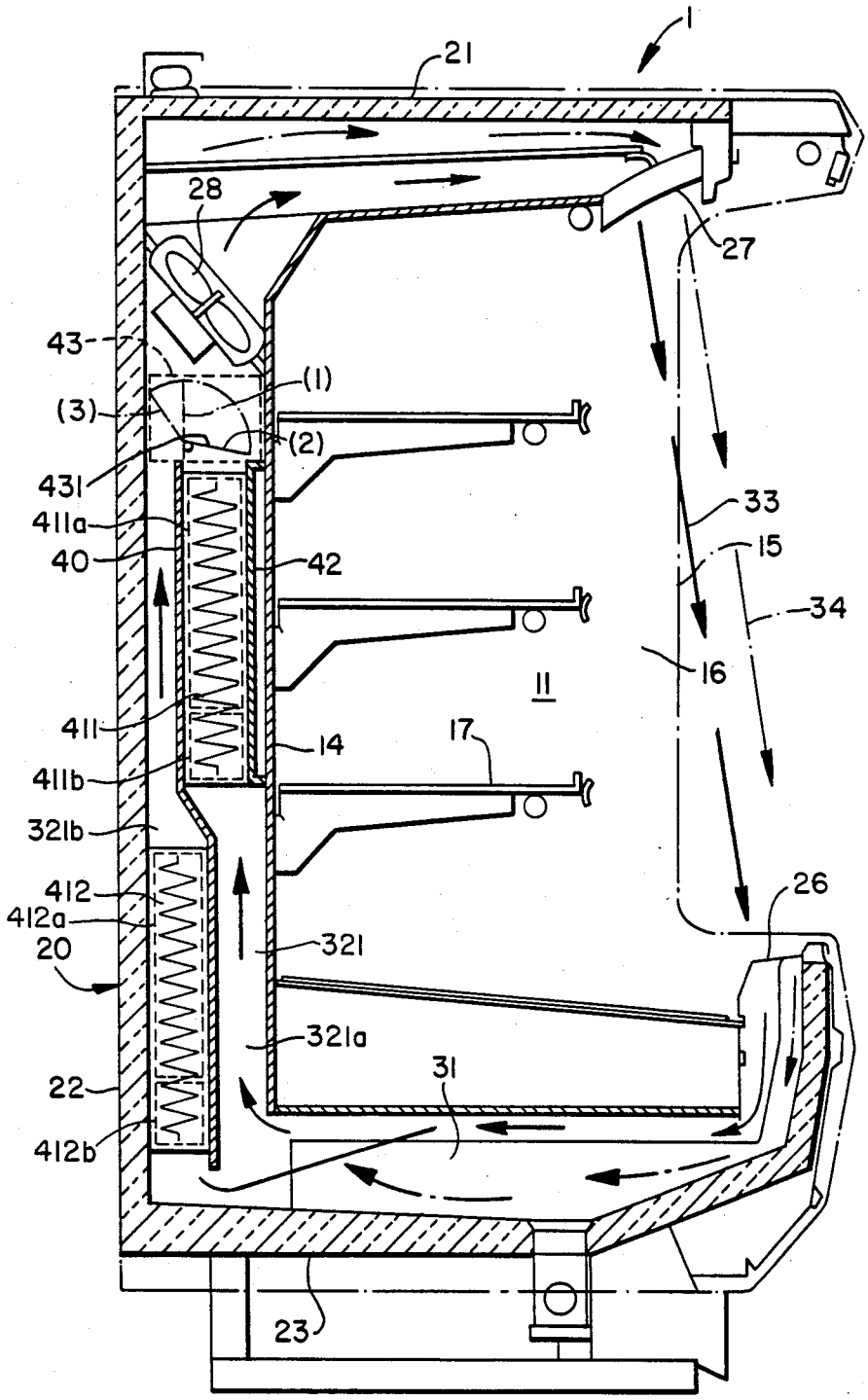

FIG. 12 is a vertical sectional view of a refrigerated display cabinet provided with a refrigerating circuit according to still another embodiment of this invention.

Figure 13:
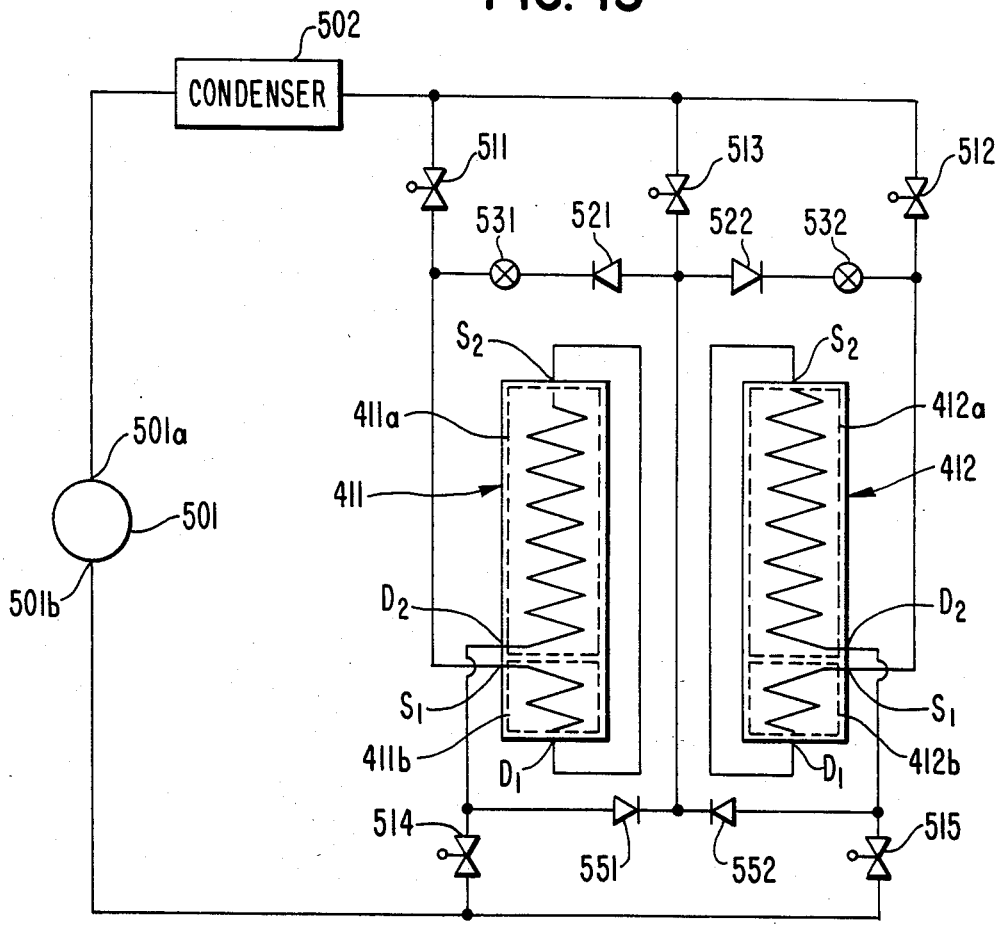

FIG. 13 shows a refrigerating circuit utilized in the refrigerated display cabinet of FIG. 12.

Figure 14:
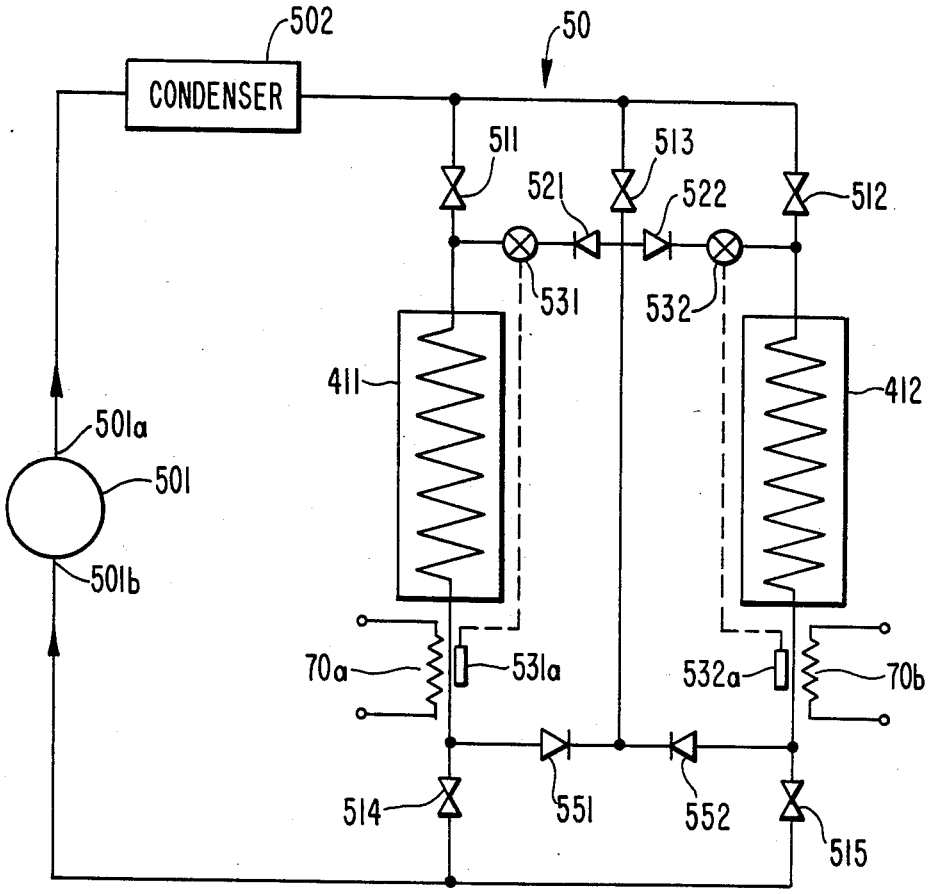

FIG. 14 shows a refrigerating circuit according to a further embodiment of this invention.

Figure 15:
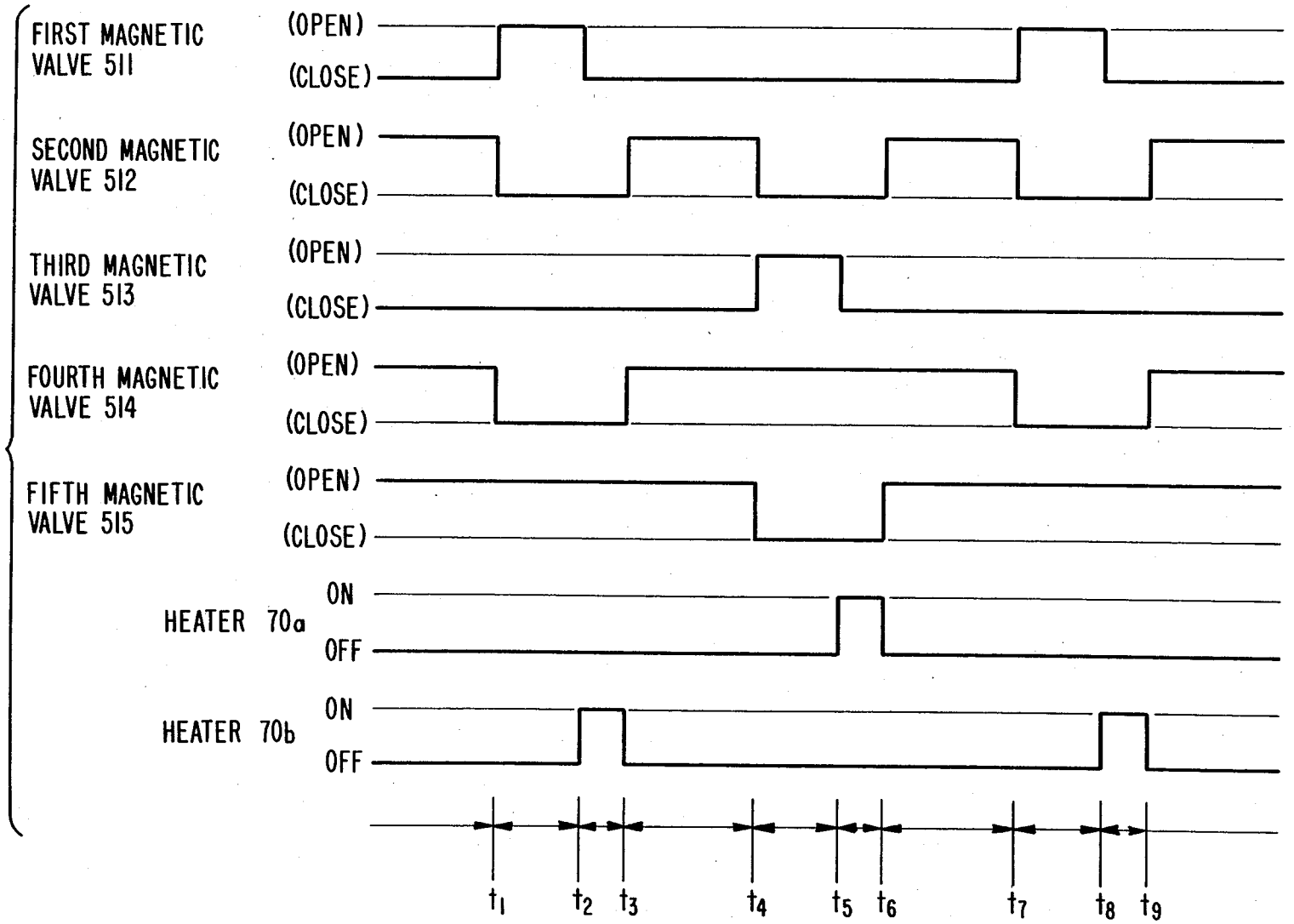

FIG. 15 is a chart illustrating the conditions of the magnetic valves and heaters of the refrigerating circuit in FIG. 14.

DETAILED DESCRIPTION OF THE PREFERRED EMBODIMENTS

Figure 1:
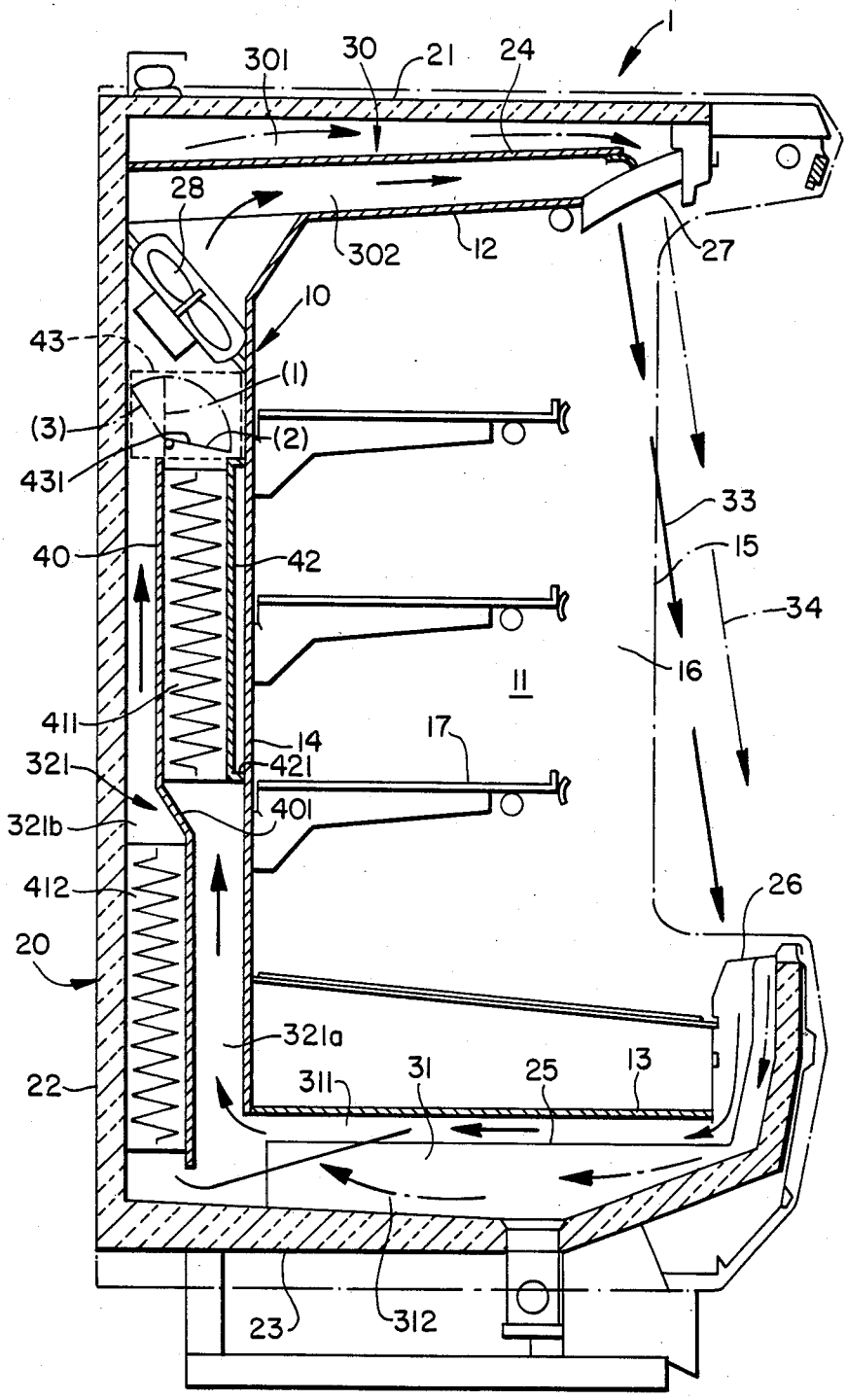
FIG. 1 is a vertical sectional view of a refrigerated display cabinet provided with a refrigerating means according to one embodiment of this invention.

Referring to FIG. 1, one embodiment of a refrigerating display cabinet 1 is shown in which a refrigerating means in accordance with the present invention is disposed. Cabinet 1 has an internal housing 10 providing a display space 11 and an external housing 20. The internal housing 10 is defined by a top panel 12, a bottom panel 13 and a rear panel 14 extending in an upright direction between the top and bottom panels 12 and 13. The display space 11 is bounded on the sides of a pair of side wall panels, only one side wall panel 15 being indicated in FIG. 1 by a two-dot and dash line. The display space 11 has a front opening 16 at its front side for easy access to the interior of the display space 11 from the outside. Furthermore, the display space 11 is divided into sections by a plurality of vertically spaced, generally horizontal shelves 17 which are mounted, preferably adjustably, on suitable uprights carried by the rear panel 14.

The external housing 20 is defined by a top wall 21, vertical rear wall 22 and a bottom wall 23, each of which is usually made of an insulating material. The space between the panels of interior housing 10 and external housing 20 provides a plurality of air flow conduits to define multiple air curtains. Thus, in a top space 30 between the top wall 21 and top panel 12, a top divider panel 24 divides space 30 into an upper passage 301 and a lower passage 302. A bottom space 31 formed between bottom panel 13 and bottom wall 23 is also divided by a bottom divider panel 25 into an upper passage 311 and a lower passage 312. A space formed between rear panel 14 and rear wall 22 is divided by two separate laterally spaced plates (not shown) to form three separate generally vertical passages which are located traversely of rear wall 22 parallel with one another.

The central passage 321 of the three passages in which a refrigerating unit is disposed communicates with the lower passage 302 of top space 30 and the upper passage 311 of bottom space 31 to form a first air circulating conduit. Both side passages of the three passages are connected with the upper passage 301 of the top space 30 and the lower passage 312 of the bottom space 31 to form a second air circulating conduit. Air inlets 26 are provided for each of the air circulating conduits. Air streams 33 and 34 which cross the front opening 16 of the display space 11 pass into these inlets 26 and are driven through the conduits to discharge outlets 27 leading from the top space 30, i.e., the air streams are recirculated in clockwise fashion as indicated on FIG. 1 by the solid and dot-dash line arrows.

As mentioned above, the first air circulating conduit is defined around the display space 11 and the refrigerated air flow through this first air circulating conduit forms an enclosing air curtain across the front opening 16 of the display space 11 by the inner air stream 33. The second air circulating conduit is also defined by the outer spaces of the top and bottom spaces and rear space between rear panel 14 and rear wall 22. The inlet and outlet of the second air circulating conduit are adjacent to and disposed outwardly of the inlet and outlet of the first air circulating conduit to form the outer air stream 34.

During normal operation, air is circulated through the first and second air circulating conduits by a plurality of motor operated fans 28 disposed in the upper portion of the rear space. The temperature of the air passed through the second air circulating conduit is slightly higher than the temperature of the air passed through the first air circulating conduit, but in any event is below the temperature of the ambient atmosphere. Therefore, the air curtain created by the air stream 34 in the second air circulating conduit tends to project against reduction of the temperature of the air stream 33 moving around the first air circulating conduit.

The central passage 321 within the rear space, which is part of the first air circulating conduit, is divided by a generally vertical partition plate 40 to form an inner passage or chamber 321*a* and an outer passage or chamber 321*b*. The width of each inner or outer passage 321*a* and 321*b* is changed by a stepped portion 401 of the partition plate 40, i.e., an enlarged width is formed at the upper part of the inner passage 321*a* and at the lower part of the outer passage 321*b*.

Evaporators 411 and 412 are disposed in the wider parts of passages 321*a* and 321*b*, respectively. The first evaporator 411, disposed in the inner passage 321*a*, is fixed between the partition plate 40 and an attachment plate 42. The second evaporator 412, disposed in the outer passage 321*b*, is fixed between the partition plate 40 and the vertical rear wall 22. The attachment plate 42 is fastened on the rear panel 14 through a flange 421 which extends across the side surface of the first evaporator 411 to cover the surface to prevent leakage of unrefrigerated air.

A damper box 43 which includes a shutter plate 431 is disposed in the upper part of the central passage 321 to cover the discharge openings of the inner and outer passages 321*a* and 321*b*, thereby serving to control the opening and closing of these discharge openings.

Figure 2:
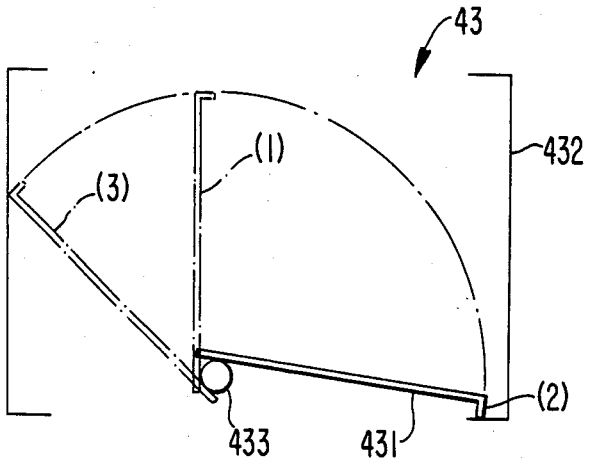
FIG. 2 is a diagrammatic sectional view of a damper box used in the cabinet of FIG. 1.

As shown in FIGS. 1 and 2, damper box 43 has a rectangular cross sectional shaped body 432 which extends over the discharge opening of central passage 321 and has top and bottom openings to accommodate air flow through body 432 of damper box 43. A rotating shaft 433 carried by body 432 is attached to shutter plate 431. Shutter plate 431 is driven by an operating source acting through shaft 433 to enable plate 431 to be set in any one of three different positions. Shutter plate 431 is placed in the midway position (this position is indicated by (1) on FIGS. 1 and 2) to allow air flow through both passages 321*a* and 321*b*. Shutter plate 431 is placed to one side (this position is indicated by (2) on FIGS. 1 and 2) where air flow passing through inner passage 321*a* is obstructed and if shutter plate 431 is positioned on the opposite side (this position is indicated by (3) on FIGS. 1 and 2) the air flow passing through outer passage 321*b* is obstructed.

Referring to FIG. 3, a refrigerating means 50 forming one embodiment of this invention to be utilized in refrigerated display cabinet 1 comprises a compressor 501, a condenser 502 and the two evaporators 411 and 412. Each of these components is serially connected with one another to form a closed loop refrigerating circuit. That is the discharge port 501*a* of compressor 501 is connected with the suction side of condensor 502. The discharge line from condensor 502 is provided with three terminals, each of which ends with a magnetic valve 511, 512 and 513, respectively. First magnetic valve 511 (which is shown on the left side of FIG. 3) is connected to the suction side of the first evaporator 411 and the second magnetic valve 512 (which is shown on the right side in FIG. 3) is connected to the suction side of the second evaporator 412. The third magnetic valve 513 (which is shown at the center position in FIG. 3) is connected to the suction side of both the first and second evaporator 411 and 412 through check valves 521 and 522, respectively. Check valves 521 and 522 prevent flow of refrigerant from the suction sides of the evaporators through expansion valves 531 and 532, respectively. The expansion valves 531 and 532 are preferably provided by a thermal automatic expansion type valve.

Also, the discharge side of each evaporator 411 and 412 is connected with the suction port 501*b* of compressor 501 through fourth and fifth magnetic valves 514 and 515, respectively. Further, both discharge sides of the first and second evaporators 411 and 412 are connected with one another through two check valves 551 and 552, these check valves preventing refrigerant flow into the evaporators. The connecting point between the opposed check valves 551 and 552 is connected with the connecting point between the check valves 521 and 522.

Figure 4:
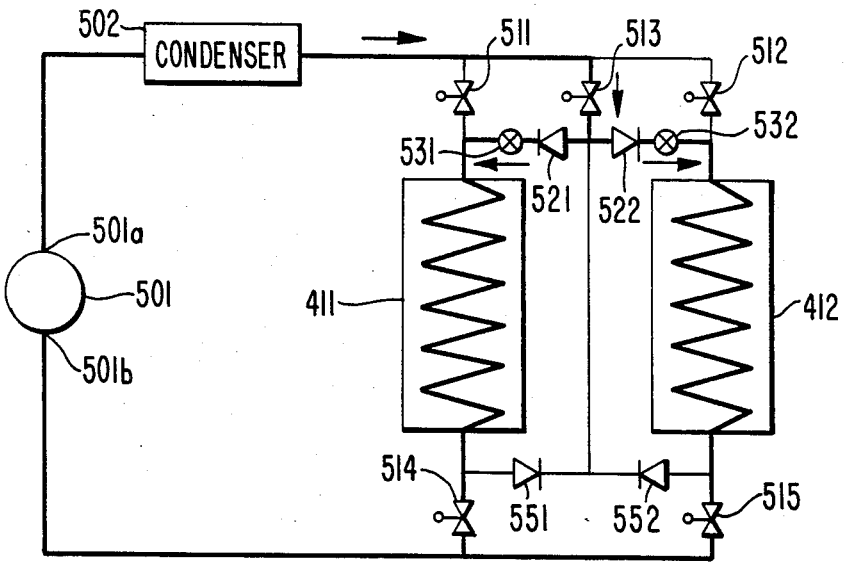
FIGS. 4–6 are schematic views of refrigerating circuits illustrating operational modes for the refrigerating means of FIG. 3.

As to the operation of refrigerating means 50, when the first and second magnetic valves 511 and 512 and closed are the remaining three magnetic valves 513, 514 and 515 are opened, the refrigerant flows into both the first and second evaporators 411 and 412 through expansion valves 531 and 532, respectively, i.e., the two evaporators 411 and 412 are placed on line in the refrigerating means 50 by means of a parallel connection. This situation is shown in FIG. 4.

At this time, shutter plate 431 in damper box 43 is positioned at the midway location (1) to open both discharge openings of the inner and outer passage 321*a* and 321*b*. Therefore, both evaporators 411 and 412 are functioning in cooling the circulating air passed through the inner and outer passages 321*a* and 321*b*. The refrigerant passed in parallel though both evaporators is returned to suction port 501*b* of compressor 501 through the open fourth and fifth magnetic valves 514 and 515.

Figure 5:
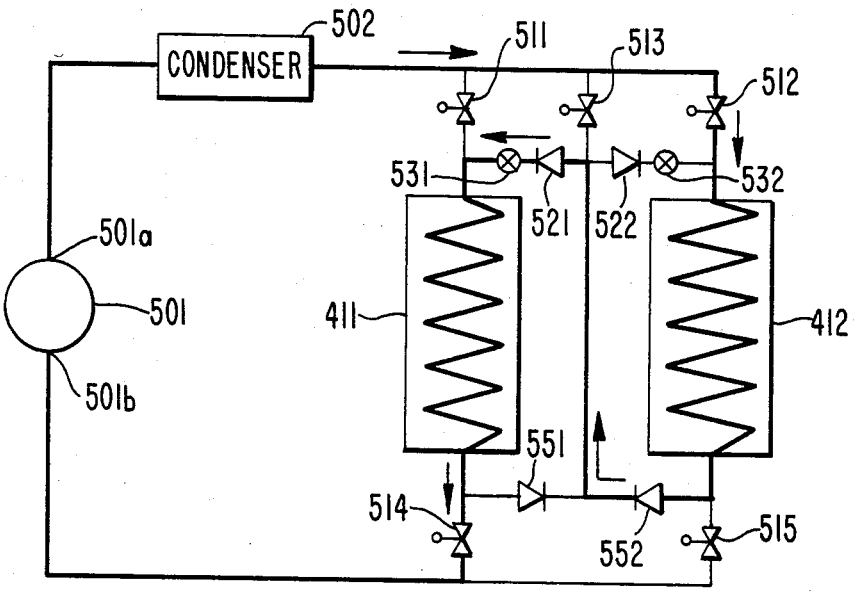

On the other hand, when the second and fourth magnetic valves 512 and 514 only are opened, the suction line of the second evaporator 412 is connected with condenser 502 and the discharge line of the first evaporator 411 is connected with suction port 501*b* of compressor 501. Thus, both evaporators 411 and 412 are serially connected on line in the refrigerating means 50. This situation is shown in FIG. 5.

At this time, shutter plate 431 is moved to position (3) to close the discharge opening of outer passage 321*b*. In this condition, since the refrigerant is passed through expansion valve 531 before flow into the first evaporator 411, the refrigerant is only expanded while passing through the first evaporator 411 to achieve heat exchange and cooling. But, the hot and high pressure refrigerant previously passes through the second evaporator 412. Therefore, the first evaporator 411 functions in cooling the circulating air passed through inner passage 321*a* while the second evaporator 412 is defrosted by the hot and high pressure refrigerant.

Figure 6:
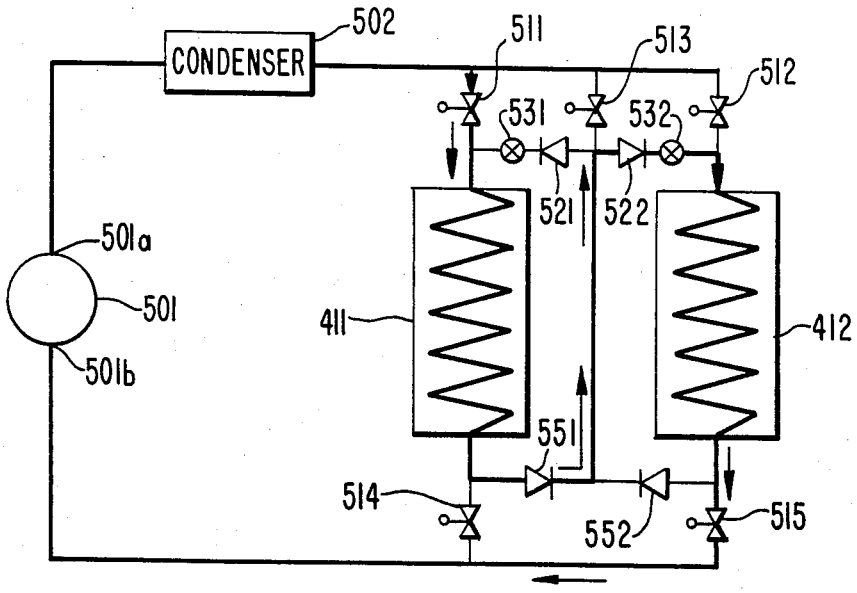
Figure 7A:
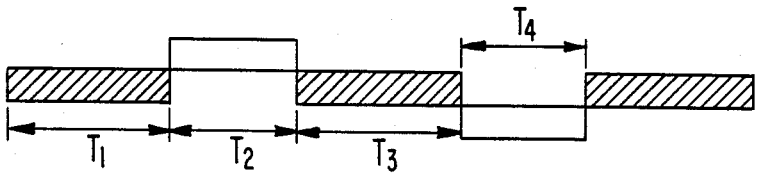
Figure 7B:
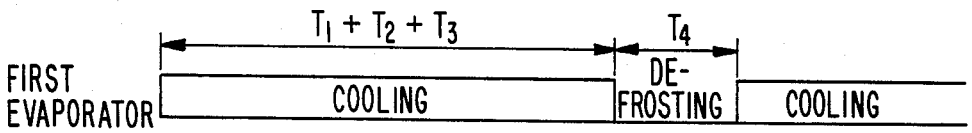
Figure 7C:
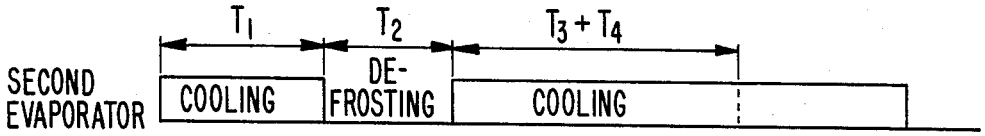

Furthermore, when only the first and fifth magnetic valves 511 and 515 are opened, the suction line of first evaporator 411 is connected with condenser 502 and the discharge line of the second evaporator 412 is connected with suction port 501*b* of compressor 501. In this situation, both evaporators 411 and 412 are serially connected with one another. This situation is shown in FIG. 6. In this condition the hot and high pressure refrigerant is passed first through the evaporator 411 and thereafter expanded through expansion valve 532 into the second evaporator 412 to achieve heat exchange with and cooling of the circulating air. Thus, the first evaporator 411 is defrosted and the second evaporator 412 cools the circulated air passed through outer passage 321*b* while shutter plate 431 in the damper box 43 has been moved to position (2).

As mentioned above, each of the two evaporators 411 and 412 is operated to successively refrigerate the circulating air and be defrosted by controlling the opening and closing of the magnetic valves. Therefore, if the operation of the magnetic valves is controlled by a timer device, the maintenance of the temperature of the circulating air and the defrosting of the evaporators can be effectively controlled.

That is, as shown in FIGS. *7a–7c*, both evaporators 411 and 412 are operated to refrigerate the circulating air during passage of a predetermined time. In FIG. *7a*, this time period is indicated by $T_1$. After this predetermined time has passed, the first evaporator 411 is still operated for refrigerating the circulating air flowing through the inner passage 321*a* while the second evaporator 412 is defrosted during passage of a second predetermined time period. In FIG. *7a*, this second timer period is indicated by $T_2$. After this predetermined time $T_2$ has passed, both evaporators 411 and 412 are operated again for refrigerating the circulating air passing through both inner and outer passages 321*a* and 321*b* while a further predetermined time period elapses. In FIG. *7a*, this further time period is indicated by $T_3$. Then after the predetermined time period $T_3$ has passed, the second evaporator 412 is still operated for refrigerating the circulating air flowing through outer passage 321*b* and the first evaporator 411 is defrosted during elapse of the predetermined time period indicated by $T_4$ in FIG. *7a*.

In summary, the above operation is shown in FIG. *7b*. The operation of the first evaporator 411 is continued during passage of the time $(T_1+T_2+T_3)$. Then, the defrosting operation of evaporator 411 is started. On the other hand, as shown in FIG. *7c*, operation of the second evaporator 412 is continued for the predetermined time $T_1$, defrosted during time $T_2$ and restarted after predetermined time $T_2$ has passed. Thereafter, the operation of the second evaporator is continued until passage of the predetermined time $(T_3+T_4+T_1)$. It will be understood that these operations are repeatedly cycled to accomplish refrigerating of the circulating air and defrosting of the evaporators.

Referring to FIG. 8, another embodiment of this invention is shown. This embodiment is directed to modification of the suction lines leading to both evaporators 411 and 412. In FIG. 8, similar parts are represented by the same reference numerals as those used on the embodiment shown in FIG. 3.

A three-way valve 57 is placed in the discharge line 501*a* of compressor 501. One discharge port 571 of three way valve 57 is connected with condenser 502 and the other discharge port 572 is connected with the first and second evaporators 411 and 412, respectively, through first magnetic valve 511 and second magnetic valve 512. The suction lines of both evaporators 411 and 412 are connected with one another through two expansion valves 531 and 532, and check valves 521 and 522 in the same manner as shown in FIG. 3. The discharge line from condenser 502 is connected with the connecting point between the two check valves 521 and 522 through a check valve 56 and a third magnetic valve 513.

In this construction of the refrigerating means 50', when the three-way valve 57 is opened through discharge port 571 and the third, fourth and fifth magnetic valves 513, 514 and 515 are opened, the refrigerant is passed in parallel through the first and second evaporators 411 and 412 to accomplish cooling of the circulating air flowing through the inner and outer passages 321*a* and 321*b*. This situation is shown is shown in FIG. 9. Therefore, both evaporators 411 and 412 are functioning to refrigerate the circulating air.

On the other hand, when the other discharge port 572 of three-way 57 is opened and only the second and fourth magnetic valves 512 and 514 are opened, the compressed refrigerant is passed through the second evaporator 412 and thereafter expanded within expansion valve 531 leading into the first evaporator 411. This situation is shown in FIG. 10. Thus, only the first evaporator 411 is functioning for cooling the circulating air flowing through inner passage 321*a* while the second evaporator 412 is being defrosted by the hot compressed gas.

Conversely, when the other discharge port 572 of three-way valve 57 is still open and only the first and fifth magnetic valve 511 and 515 are opened, the compressed refrigerant passes through the first evaporator 411, check valve 551 and is expanded within expansion valve 522 into the second evaporator 412. This situation is shown in FIG. 11. Thus only the second evaporator 412 is functioning for cooling the circulating air passed through other passage 321*b* and the first evaporator 411 is being defrosted by the hot compressed refrigerant.

FIGS. 12 and 13 show still another embodiment of the refrigerating means according to this invention in which the refrigerant flow path structure of each evaporator is modified from that previously described. In this embodiment, each evaporator 411 and 412 comprises two heat exchanger elements 411*a* and 411*b*; 412*a* and 412*b*, both of which elements are provided with a suction line and a discharge line, respectively. The volume of the upper positioned heat exchanger elements 411*a* and 412*a* is constructed to be larger than the volume of the lower positioned heat exchanger elements 411*b* and 412*b*.

As shown in FIG. 13 the suction line $S_1$ of the lower positioned heat exchanger element 411*b* is connected with condenser 502. The discharge line $D_1$ of the lower positioned heat exchanger element 411*b* is connected with suction line $S_2$ of the upper positioned heat exchanger element 411*a*. Then the discharge line $D_2$ of the upper positioned heat exchanger element 411*a* is connected with the suction port 501*b* of compressor 501 to form one flow path for the refrigerant.

In this construction of the refrigerating means as shown in FIG. 12, both evaporators 411 and 412 are placed within the inner and outer passages 321*a* and 321*b* to have the lower positioned heat exchanger elements 411*b* and 412*b* disposed toward the direction of air flow into these passages. Therefore, when the defrosting mode of the refrigerating means is started, the compressed refrigerant is first passed through the lower positioned heat exchanger elements 411*b* and 412*b* for defrosting the lower portion of each evaporator. Thus, the lower positioned frost on evaporators 411 and 412 is easily defrosted and warm air around the lower portions of the evaporators rises upwardly along the evaporators. This warm air and the compressed refrigerant passed through the upper positioned heat exchanger elements 411*a* and 412*a* promotes defrosting of the upper portions of the evaporators. Since the warm air rising from the lower portions of the evaporators is promoting heat exchange with frost on the evaporators to assist in its melting, the temperature around the discharge openings of the inner and outer passages is not greatly influenced by the defrosting operation. As a result of above function, the refrigerating efficiency is improved.

In the above structure of the refrigerating means, changing from the defrosting mode for one evaporator to this mode for another evaporator could result in the refrigerating mode of both evaporators being passed. Therefore, if the magnetic valves which are disposed on the suction and discharge lines of the defrosted evaporator are opened, liquid refrigerant filling the defrosted evaporator can be directly returned to the suction side of compressor 501. This liquid refrigerant can cause several problems, for example, destruction of the compressor. Thus, during change of modes, the liquid refrigerant should be passed through the expansion valve leading to another evaporator to be vaporized.

When liquid refrigerant in a defrosted evaporator flows into a refrigerating evaporator through an expansion valve without refrigerant flow from the condensor, the pressure in the defrosted evaporator suddenly drops and the pressure difference between the suction side and discharge side of the expansion valve which is disposed on the evaporator operating in the refrigerating mode is such that the expansion valve is suddenly closed. Thus, the amount of flow of refrigerant from the defrosted evaporator to the refrigerating evaporator is reduced. As a result of these facts, the operation of collecting refrigerant takes a relatively long time and finally the temperature in the refrigerating space of the cabinet rises because the step change from the defrosting mode to the refrigerating mode takes a long time while the refrigerating means is being driven at a relatively low capacity.

Also, the operation of the expansion valve is controlled by a sensing element (see FIG. 14) disposed on the discharge line of each evaporator to detect the temperature of the discharge line. If the temperature of the discharge line is increased, the opening angle of the expansion valve is increased and reversely if the temperature of the discharge line is decreased, the opening angle of the expansion valve is decreased. Therefore, if the above problems are to be resolved, the sensing elements 531*a* and 532*a* should be heated to increase the opening angle of the expansion valve as shown in FIG. 14. The operation of this heater will be described with referring to FIGS. 14 and 15.

During operation in the refrigerating mode, if the first magnetic valve 511 is opened and the second and fourth magnetic valves 512 and 514 are closed, the defrosting mode for the first evaporator 411 is started. This time is indicated by $t_1$ in FIG. 15. Before changing from the defrosting mode for the first evaporator to the refrigerating mode, the refrigerant collecting mode starts. This starting being indicated by $t_2$ in FIG. 15 i.e., the first magnetic valve 511 is closed and the heater 70*b* which is disposed on the discharge line of second evaporator 412 is turned on. At that time, since sensing element 532*a* of expansion valve 532 disposed on the suction line of the second evaporator 412 is heated, the liquid refrigerant filling the first evaporator 411 easily flows into the second evaporator 412, passing through the expansion valve 532. Therefore, the collection of liquid refrigerant in the first evaporator 411 is smoothly handled within a short time period to thereby maintain a minimum change in temperature within the refrigerating space.

When the predetermined time $t_3$ indicated in FIG. 15 has elapsed, heater 70*b* is turned off and the five magnetic valves are set up to carry out the function of the refrigerating mode.

Changing modes from the defrosting mode of the second evaporator to the refrigerating more operates in the same manner as mentioned above with reference to the defrosting mode of the first evaporator.

This invention has been described in detail in connection with preferred embodiments, but these embodiments are examples only and the invention is not to be considered as restricted thereto. It will be easily understood by those skilled in the art that other variations and modifications can be easily made within the scope of the appended claims.

We claim:

1. In a refrigerated display cabinet comprising an external housing, an internal housing within the external housing for storing merchandise, a front opening for access to the interior of said internal housing, passage means formed between said external and internal housing including inner and outer conduits interconnecting respective inlets and outlets extending across opposed edges of said front opening, circulating means for driving air around said passages means from said outlets to said inlets in the form of inner and outer air curtains, and refrigerating means in the inner conduit for refrigerating the inner curtain of air, the improvement comprising said refrigerating means including a compressor, a condenser and two evaporators, the inlet sides of said evaporators being connected with one another by a first passage line in which first and second decompression devices with check valves disposed in series with located said line having the ends thereof communicated with said compressor through valve devices, said evaporators having their outlet sides connected with one another by a second passage line in which two check valve devices are disposed in series with the ends of said second line respectively connected to said compressor through valve devices, and said first and second passage lines being connected with one another and connected to said condenser through a valve device.

2. The refrigerant display cabinet of claim 1 wherein said decompression devices each comprise an expansion valve.

3. The refrigerant display cabinet of claim 2 wherein each said expansion valve is a thermal automatic expansion valve, and a heating device is disposed on a sensing element of each said expansion valve.

4. The refrigerant display cabinet of claim 2 wherein said inlet sides of said evaporators are respectively connected to said condensor through said valve devices.

5. The refrigerant display cabinet of claim 2 wherein said inlet sides of said evaporators are respectively connected to one discharge port of a three way valve device and the other discharge port of said three way valve device is connected to the suction side of said condenser.

6. The refrigerant display cabinet of claim 1 wherein each said evaporator comprises two heat exchanger elements which are connected in series, and the lower positioned heat exchanger element is connected with the discharge side of said condenser.

7. The refrigerant display cabinet of claim 6 wherein the heat exchanging volume of said lower positioned heat exchanger element is smaller than the heat exchanging volume of the upper positioned heat exchanger element.

8. The refrigerated display cabinet of claim 1 wherein said valve devices are controlled by timer means for cycling operation of said evaporators between the refrigerating mode and defrosting mode.

* * * * *